US009785079B2

(12) United States Patent
Deprez et al.

(10) Patent No.: US 9,785,079 B2
(45) Date of Patent: Oct. 10, 2017

(54) DIGITAL PRINTING APPARATUS AND DIGITAL PRINTING PROCESS

(71) Applicant: Xeikon Manufacturing N.V., Lier (BE)

(72) Inventors: Lode Erik Dries Deprez, Wachtebeke (BE); Werner Jozef Johan Op De Beeck, Putte (BE); Geert Gaston Paul Deroover, Lier (BE)

(73) Assignee: Xeikon Manufacturing N.V., Lier (BE)

( * ) Notice: Subject to any disclaimer, the term of this patent is extended or adjusted under 35 U.S.C. 154(b) by 39 days.

(21) Appl. No.: 14/392,265

(22) PCT Filed: Apr. 24, 2014

(86) PCT No.: PCT/NL2014/050265
§ 371 (c)(1),
(2) Date: Dec. 24, 2015

(87) PCT Pub. No.: WO2014/209108
PCT Pub. Date: Dec. 31, 2014

(65) Prior Publication Data

US 2016/0291496 A1 Oct. 6, 2016

(30) Foreign Application Priority Data

Jun. 28, 2013 (NL) ..... 2011064

(51) Int. Cl.
*G03G 13/10* (2006.01)
*G03G 9/135* (2006.01)
(Continued)

(52) U.S. Cl.
CPC ..... *G03G 9/135* (2013.01); *G03G 9/125* (2013.01); *G03G 13/10* (2013.01); *G03G 15/11* (2013.01)

(58) Field of Classification Search
CPC ..... G03G 13/10
See application file for complete search history.

(56) References Cited

U.S. PATENT DOCUMENTS 9,588,464 B2 * 3/2017 Deprez ..... G03G 15/657
2009/0052948 A1 2/2009 Ozerov et al.
(Continued)

FOREIGN PATENT DOCUMENTS

JP 2009157346 A 7/2009

OTHER PUBLICATIONS

Jul. 25, 2014—(WO) International Search Report and Written Opinion—App PCT/NL2014/050265.

*Primary Examiner* — Joshua D Zimmerman
(74) *Attorney, Agent, or Firm* — The Webb Law Firm

(57) ABSTRACT

A digital printing apparatus using liquid toner comprising carrier liquid, a dispersing agent and imaging particles, the apparatus comprising: an imaging member adapted to sustain a pattern of electric charge forming a latent image on its surface; a development member arranged to receive a quantity of liquid toner; and to develop said latent image by transferring a portion of said quantity of liquid toner onto said imaging member in accordance with said pattern; a melting unit arranged downstream of the imaging member and configured to melt imaging particles of a transferred part of the portion of liquid toner, said part being transferred from the imaging member, wherein there is provided a dispersing capacity modification unit downstream of the imaging member, said dispersing capacity modification unit being configured for reducing the dispersing capacity of the dispersing agent in the transferred part of the portion of liquid toner.

14 Claims, 4 Drawing Sheets

Figure 1:
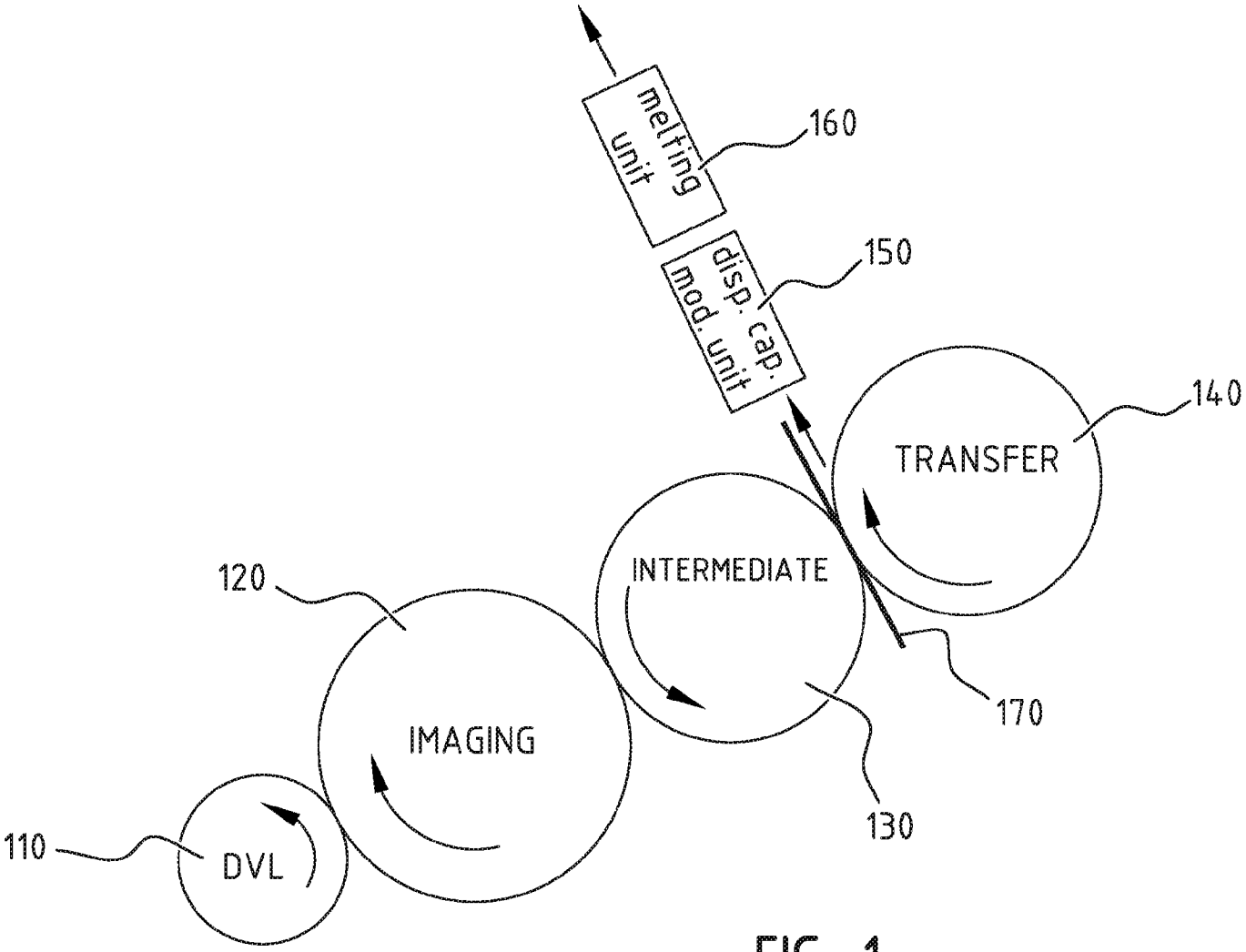

(51) Int. Cl.
*G03G 15/11* (2006.01)
*G03G 9/125* (2006.01)

(56) References Cited

U.S. PATENT DOCUMENTS

2009/0148785 A1 6/2009 Yogome
2016/0177118 A1* 6/2016 Deroover ..... B01F 17/0021
428/195.1

* cited by examiner

DIGITAL PRINTING APPARATUS AND DIGITAL PRINTING PROCESS

The application is a U.S. National Phase Entry of International Application No. PCT/NL2014/050265 filed on Apr. 24, 2014, designating the United States of America and claiming priority to The Netherlands Patent Application No. 2011064 filed Jun. 28, 2013. The present application claims priority to and the benefit of the above-identified applications and the above-identified applications are incorporated by reference herein in their entirety.

The present invention relates to a digital printing apparatus and process using liquid toner, to a dispersing capacity modification unit for use in such an apparatus or process, and to a toner liquid, in particular a toner liquid for use in such a digital printing apparatus or process.

An apparatus using liquid toner is known from US patent application with publication no. 2009/0052948. A problem of known high viscosity or high concentration liquid developer dispersions is that the fusing process may be hindered by the presence of dispersing agent in the carrier liquid or on the surface of the toner particles. More in particular the dispersing agent may have a negative influence on the formation of a film of marking particles, and thus may prevent coalescence of marking particles. This may result in a low quality of the printed image and a poor adhesion of melted marker particles to the substrate.

It is a purpose of the present invention to provide a digital printing apparatus and process using liquid toner, as well as a liquid toner, in particular high-solid-content toner, overcoming some or all of the above mentioned disadvantages.

This purpose is achieved by an embodiment of the apparatus or process of the invention comprising the features of claim 1 or 9, respectively. An embodiment of a digital printing apparatus of the invention comprises an imaging member adapted to sustain a pattern of electric charge forming a latent image on its surface; a development member arranged to receive a quantity of liquid toner; and to develop said latent image by transferring a portion of said quantity of liquid toner onto said imaging member in accordance with said pattern. Further, there is provided a dispersing capacity modification unit downstream of the imaging member and a melting unit arranged downstream of the imaging member. The dispersing capacity modification unit is configured for reducing the dispersing capacity of the dispersing agent in a part of the portion of liquid toner, that is transferred from the imaging member to a substrate. The melting unit is arranged downstream of the imaging member and is configured to melt imaging particles of the transferred part of the portion of liquid toner.

Embodiments of the invention are based inter alia on the insight that, on the one hand, the dispersing agent is needed to ensure the stability of the imaging particles in the liquid toner dispersion, typically both during and after the preparation of the toner, and on the other hand, the dispersing agent distorts the fusing process. Indeed, the dispersing agent may interfere with the fusing process, making it more difficult for the imaging particles to form a film. By reducing or eliminating the dispersing capacity of the dispersing agent at a suitable point in the printing process, the stability of the imaging particles in the liquid developer dispersion is reduced, resulting in an improved fusing process. Further, in certain embodiments, reducing or eliminating the dispersing capacity of the dispersing agent at a suitable point in the printing process, may result in an improved transfer process, when the adhesion properties of the liquid toner can be changed, or when the disturbance of the dispersion stability facilitates the adhesives transfer.

In the context of the present application the term "dispersing capacity" refers to the capacity of the dispersing agent to separate the marking particles, i.e. to prevent settling or clumping, in the carrier liquid, and in particular to prevent having a high viscosity in high dispersion concentration systems. In typical toner liquids the viscosity will be a measure for the dispersing capacity of the dispersing agent. For certain dispersing agents, another way of measuring the dispersing capacity is performing a so called "hotplate test" on the toner liquid. A hotplate test is a test where the liquid toner is put on a hot plate of e.g. 150° C. The toner liquid can collapse in two phases, a marking particle phase and a carrier liquid phase. When after 60 seconds the liquid toner does not collapse, and there is no phase separation of the toner liquid, this indicates that the liquid toner is stable. On the other hand, when the liquid toner collapses within 60 seconds, and there is a phase separation, this indicates that the liquid toner is unstable.

Preferably, the dispersing capacity modification unit is configured for reducing the dispersing capacity of the dispersing agent by subjecting the dispersion agent to a chemical modification of the dispersing agent. This chemical modification may e.g. be a conformational change of the dispersing agent or a decomposition of the dispersing agent. This chemical modification changes the dispersing capacity of the dispersing agent. In exemplary embodiments, the dispersing capacity modification unit may be configured to subject the transferred part of the portion of liquid toner to any one of the following stimuli: UV light, ultrasonic waves, infrared light, microwaves, a change in temperature, or a change in pH value. According to another embodiment the dispersing capacity modification unit may be configured to add a compound capable of altering the dispersing properties of the dispersing agent. The compound may be such that the dispersing agent is chemically modified.

In preferred embodiments, the melting unit is configured to cause a physical process in the toner, namely the softening and melting of the imaging particles, whilst the dispersing agent modification unit is configured to chemically modify the dispersing agent in order to convert a stable dispersion into a destabilized dispersion. Chemical modification can for example be a conformational change in or a decomposition of the dispersing agent to destabilize the dispersion.

The melting unit and the dispersing agent modification unit may be separate units, but may also be grouped in a single unit causing both the melting of the imaging particles and the dispersing capacity modification of the dispersing agent, simultaneously or sequentially.

In a possible embodiment the dispersing capacity modification unit is arranged upstream of the melting unit. However, in alternative embodiments the dispersing capacity modification unit may be arranged downstream of the melting unit, or both units may be operational at the same location, both units optionally being integrated in a single unit.

In a possible embodiment the apparatus comprises a substrate support member for supporting a substrate downstream of the imaging member. The dispersing capacity modification unit and/or the melting unit may be arranged for operating on liquid toner present on a substrate on the substrate support member. In other words, according to this embodiment the dispersion capacity modification is done after transferring the liquid toner on the substrate. In another embodiment the apparatus comprises an intermediate member for transferring a part of the portion of liquid toner of the imaging member to a substrate; and the dispersing capacity modification unit and/or the melting unit may be arranged for operating on liquid toner present on the intermediate member. In other words, according to this embodiment the dispersion capacity modification is done on an intermediate member, downstream of the imaging member, before transferring the liquid toner on the substrate.

According to another aspect of the invention there is provided a digital printing process using liquid toner, said liquid toner comprising imaging particles, a carrier liquid, and a dispersing agent. The process comprises

- producing a latent image as a pattern of electric charge on an imaging member;
- transferring a quantity of liquid toner onto a development member;
- developing said latent image by transferring a portion of said quantity of liquid toner onto said imaging member in accordance with said pattern;
- reducing the dispersing capacity of the dispersing agent in a portion of liquid toner dispersion transferred from the imaging member, i.e. on a member downstream of the imaging member;
- melting imaging particles of the portion of liquid toner dispersion transferred from the imaging member; and
- adhering said melted imaging particles to a substrate.

Preferably the reduction of the dispersing capacity is performed by chemically modifying the dispersing agent in the portion of liquid toner transferred from the imaging member, so that the dispersing capacity of the dispersing agent is strongly reduced or removed. The chemical modification may consist e.g. of a conformational change or a decomposition. In exemplary embodiments, the portion of liquid toner transferred from the imaging member is subjected to a stimulus in order to cause a reaction reducing the dispersing capacity of the dispersion agent. The stimulus may be visible light, UV-light, infrared light, microwave, a change in temperature, a change in pH value, a contact with a compound, or a combination of any of those stimuli. Thermal decomposition can occur at a temperature above 60° C., preferably above 70° C., and more preferable above 80° C.

In embodiments of the invention the reducing of the dispersing capacity is performed before the melting. Alternatively the reducing of the dispersing capacity and the melting may be performed simultaneously, or the reducing may be performed shortly after the melting while the imaging particles are still in the molten phase.

The reduction of the dispersing capacity may be performed on an intermediate member, downstream of the imaging member, or on the substrate.

In exemplary embodiments, the substrate may contain a compound that alters the dispersing properties of the dispersing agent. The compound may be such that the dispersing agent is chemically modified, e.g. by catalytic reactions by metal salts, photoacids, acid base interactions, catalytic ring opening or retro pericyclic reactions. In such an embodiment a dispersion capacity modification unit may be omitted if the stimulus for causing the dispersion capacity reduction is present in the printing substrate. In certain embodiments the stimulus may be a combination of a compound in/on the substrate and a further stimulus, e.g. UV light.

In another aspect, the invention is related to a toner liquid comprising a carrier liquid, a marking particle and a stimulus responsive dispersing agent of which the dispersing capacity reduces after exposure to a stimulus.

The inventors surprisingly found that by exposing the toner liquid to a stimulus, the dispersing capacity of the stimulus responsive dispersing agent reduces. The toner liquid is a dispersion of marking particles in a carrier liquid, wherein the marking particles are compatible with the carrier liquid through the help of a dispersing agent. After exposure to a stimulus, the liquid toner destabilizes, or tends to destabilize due to the reduction of the dispersing capacity of the stimulus responsive dispersing agent. The toner liquid forms or tends to form, after exposure to a stimulus, two different phases, namely the carrier liquid phase and the marking particle phase. The toner liquid is no longer the stable dispersion from the start since the marking particles and the carrier liquid are less compatible.

Preferably, the marking particles comprise colored particles (also called ink particles, dyes or pigment) and a binder resin, which is a polymer, preferably transparent, that embeds the ink particles and other optional compounds like wax, plasticizer or other additives. Preferably, the marking particles are extrudates of the binder resin and the colored particles. In a special case non colored particles can be used e.g. for creating special gloss effects or for the printing of certain security features.

Preferably, the carrier liquid is a suitable liquid as is known in the art, and may be silicone fluids, hydrocarbon liquids, vegetable oils, modified vegetable oils, or any combinations thereof.

Preferably, the stimulus responsive dispersing agent comprises an anchoring part, a stabilizing part and a stimulus responsive part. The anchoring part interacts with the marking particle and is chemically compatible with the marking particle. The stabilizing part stabilizes the marking particle in the carrier liquid. After exposure to a stimulus, the stimulus responsive part changes and the liquid toner collapses or tends to collapse into a carrier liquid phase and a marking particle phase. It is possible that the stimulus responsive dispersing agent, a part of it, or a decomposed stimulus responsive dispersing agent or a part of it, after the stimulus, forms part of the carrier liquid phase or the marking particle phase. In case the stimulus responsive dispersing agent, a part of it, or the decomposed stimulus responsive dispersing agent, or a part of it, forms part of the carrier liquid phase, the dispersing agent is preferably chosen in such a way that it has a minor or no influence on the conductivity of the carrier liquid phase (especially in cases where the carrier liquid is collected after the collapse).

In an embodiment, the stimulus responsive part is a conformational changeable stimulus responsive part which undergoes a conformational change upon exposure to a stimulus. Due to the conformational change of the stimulus responsive part, the stimulus responsive dispersing agent undergoes a conformational change reducing the dispersing capacity of the liquid toner. Preferably, the conformational change of the stimulus responsive part is irreversible during a period that is sufficiently long for performing a digital printing process.

In an embodiment, the stimulus responsive part is decomposable and the stimulus responsive dispersing agent decomposes in two or more parts. The decomposing in two or more parts may occur through braking of a covalent bound in the stimulus responsive part. The decomposing in to or more parts may also occur because the stimulus responsive part comprises a salt bridge which breaks in two parts after exposure to a stimulus. The two parts may be a part with a positive charge and a part with a negative charge. The decomposing causes that the stabilizing part and the anchoring part are no longer connected and that the dispersing capacity of the stimulus responsive dispersing agent reduces. Preferably, the decomposing of the stimulus responsive part is irreversible during a period that is sufficiently long for performing a digital printing process.

Preferably the stimulus is visible light, UV-light, infrared light, microwave, a change in temperature, a change in pH value, or a contact with a compound. For example, a change in pH can decompose a salt bridge. Another example is that a microwave can cause an increase of the temperature of the stimulus responsive dispersing agent, causing it to decompose or to change conformationally, while the temperature of the carrier liquid does not change, or increases only slightly.

In an embodiment the anchoring part and/or the stabilizing part comprises the stimulus responsive part. For example, the stabilizing part or the anchoring part can be the stimulus responsive part. According to another example, the stimulus responsive part is a part of the stabilizing part and/or the anchoring part. Alternatively, the stimulus responsive part connects the stabilizing part with the anchoring part.

Preferably, the stimulus responsive dispersing agent comprises 1, 2, 3, 4, 5, 6, 7, 8, 9, 10 or more stimulus responsive parts. The amount of stimulus responsive parts depends on the size and molecular weight of the dispersing agent. Further, the amount of the stimulus responsive part in the stimulus responsive dispersing agent depends on the response efficiency and kinetics of the part towards the stimulus in the printing process.

Preferably, the anchoring part interacts with the marking particle and is compatible with the marking particle. Preferably, the anchoring part is compatible with the resin, the plasticizer and/or the pigment of the marking particle. Preferably, the anchoring part is selected from the group consisting of: aromate, polyaromate, heteroaromate, polyamide, such as carboxylated polyethylenimine, polyester, polyurethane, polyketon, poly(acrylo)nitrile, polyacrylate, vinylether polymer arylvinyl polymer, and a copolymer of vinylether and arylvinylether, or a derivative thereof, or any combination thereof. Preferably, the anchoring part is a caboxylated polyethylenimine (PEI). PEI interacts well with a marking particle that comprises polyester.

Preferably, the stabilizing part stabilizes the marking particle in the carrier liquid. Preferably, the stabilizing part is selected from the group consisting of: polysiloxane, polyhydroxystearic acid, polyricinoleic acid, polyacrylate, polyacrylate with long aliphatic chains such as poly-stearic acrylate, polystyrene, polyarylether and polyethylene, or a derivative thereof, or any combination thereof. Preferably, the stabilizing part is polyhydroxystearic acid.

In another embodiment is the stimulus responsive dispersing agent selected from the group consisting of:

an ortho-nitrobenzyl derivative comprising the anchoring part and the stabilizing part, that after stimulation is decomposed in a 2-nitrosobenzaldehyde derivative and the anchoring part and the stabilizing part, and where the nitrobenzyl derivative comprises or is part of the stabilizing part or the anchoring part;

a derivative of bis(2-nitrophenyl)methylformate, comprising the anchoring part and the stabilizing part, that decomposes, after exposure to a stimulus, in (2-nitrophenyl)(2-nitrosophenyl)methanone derivative and the stabilizing part, and whereby the (2-nitrophenyl)(2-nitrosophenyl)methanone derivative comprises or forms part of the anchoring part;

a derivative of (E)-di(propan-2-yl)diazene comprising the anchoring part and the stabilizing part, wherein, after exposure to a stimulus, the derivative is decomposed in nitrogen, the anchoring part and the stabilizing part;

a benzoine derivative with the structural formula (I), wherein R1, R2, R3 and/or R4 form part of the anchoring part, and X comprises the stabilizing part, wherein, after exposure to a stimulus, the derivative is decomposed in derivatives of a compound with the structural formulas (II) and (III):

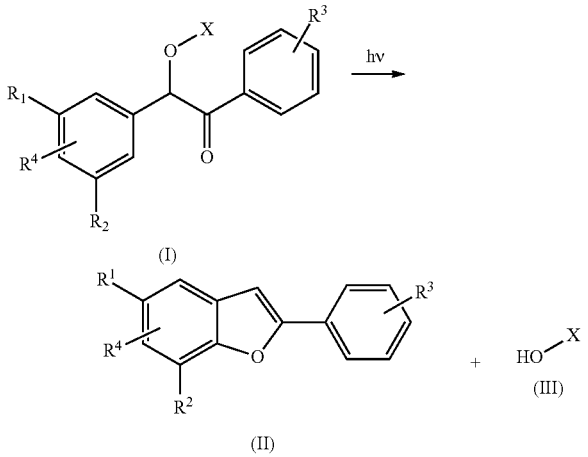

a benzoine derivative comprising the structural formula (IV), wherein R1, R2, R3 and/or R4 form part of, or comprise the anchoring part, and X comprises the stabilizing part, wherein, after exposure to a stimulus, the derivative is decomposed to derivatives having the structural formulas (V) and (VI);

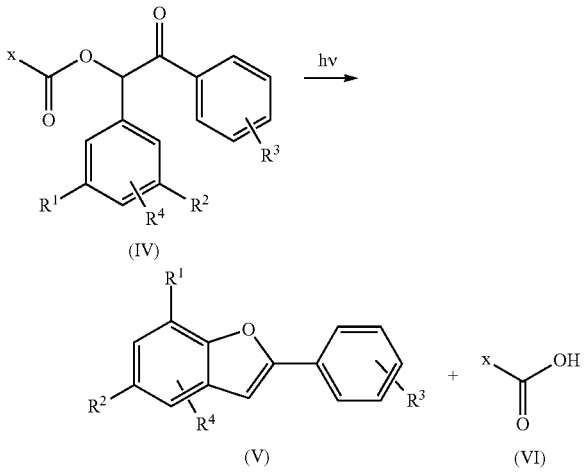

a derivative of hydroxyacetophenone (HAP) comprising the anchoring part and the stabilizing part, that decomposes, after exposure, in a phenylacetone derivative and the stabilizing part, wherein the phenyl acetone derivative comprises or forms part of the anchoring part;

a derivative of alkoxy acetophenone comprising the structural formula (VII), wherein X forms part of, or comprises the stabilizing part, and R1, R2 and/or R3 form part of the anchoring part, wherein the derivative, after exposure to a stimulus, decomposes to derivatives with the structural formula (VIII) and (IX);

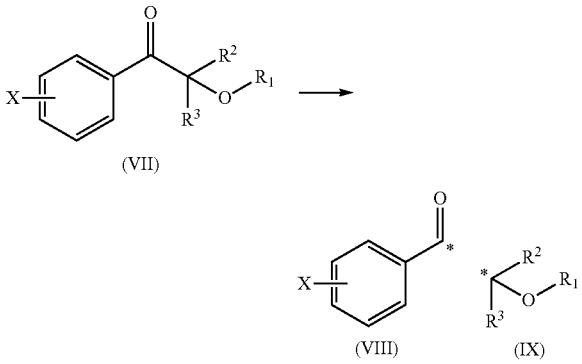

an alkylaminoacetophenone derivative (AAAP) comprising the anchoring part and the stabilizing part that decomposes, after exposure to a stimulus, in a phenylacetone derivative and an amino derivative, and wherein the phenylacetone derivative comprises or forms part of the anchoring part and the amino derivative comprises or forms part of the stabilizing part;

a derivative comprising the structural formula (XI), wherein X forms part of, or comprises the anchoring part, and R1, R2, R3 and/or R4 form part of, or comprise the stabilizing part, wherein the derivative, after exposure to a stimulus, decomposes in derivatives with the structural formulas (XII) and (XIII), or in derivatives with the structural formulas (XIV) and (XV):

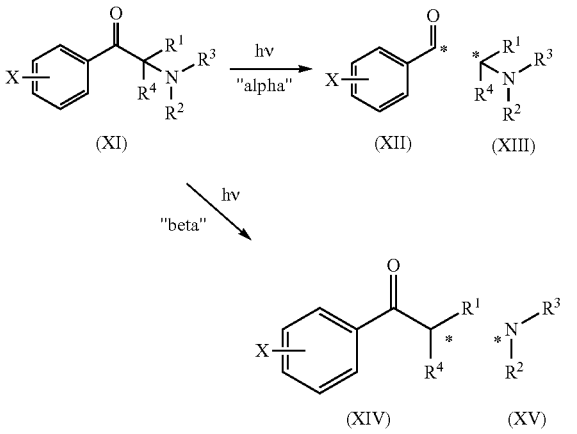

a benzyl ketal derivative comprising the structural formula (XVI) comprising an anchoring and a stabilizing part, wherein R1, R2 and/or R3 form part of, or comprise the stabilizing part, and X comprises or form part of the anchoring part, wherein the derivative decomposes, after exposure to a stimulus, in derivatives with the structural formula (XVII) en (XVIII);

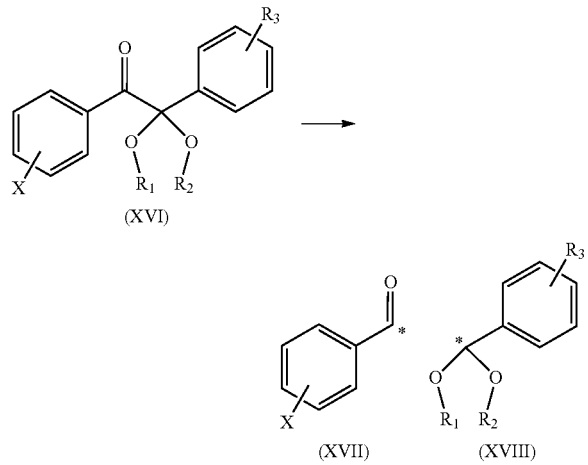

a TPO derivative (i.e. a derivative of (diphenylphosphoryl)(2,4,6-trimethylphenyl)methanone) comprising the anchoring part and the stabilizing part and/or wherein the TPO group forms part or comprises the anchoring part;

a TPO-L derivative (i.e. a derivative of phenyl-(2,4,6-trimethyl-benzoyl)-phosphinic acid ethyl ester) comprising the anchoring part and the stabilizing part and/or of which the TPO-L group forms part of the anchoring part;

a BAPO derivative ((i.e. a derivative of [phenyl-(2,4,6-trimethyl-benzoyl)-phosphinoyl]-(2,4,6-trimethyl-phenyl)-methanon) comprising the anchoring part and the stabilizing part, and/or wherein the BAPO group forms part of the anchoring part; or a combination thereof.

In another embodiment, the dispersing agent comprises a photoisomerisalble group that is selected from the group consisting of:

a derivative of trans-stilbene (i.e. a derivative of 1,1'-(E)-ethene-1,2-diyldibenzene) comprising the structural formula (XIX) which after stimulation changes in a cis-stilbene derivative (1,1'-(Z)-ethene-1,2-diyldibenzene) comprising the structural formula (XX) where R forms part of, or comprises the anchoring part and X forms part of or comprises the stabilizing part;

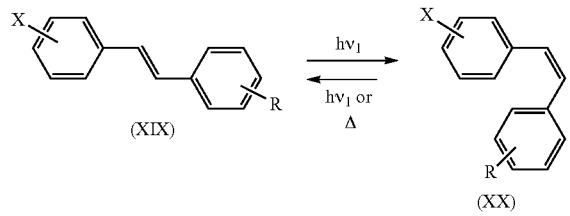

a derivative of trans-azobenzene (i.e. (E)-diphenyldiazene) comprising the structural formula (XXI) that after stimulation changes to a cis-azobenzene derivative (i.e. (Z)-diphenyldiazene) comprising the structural formula (XXII) where R forms part of or comprises the anchoring part, and X forms part or comprises the stabilizing part;

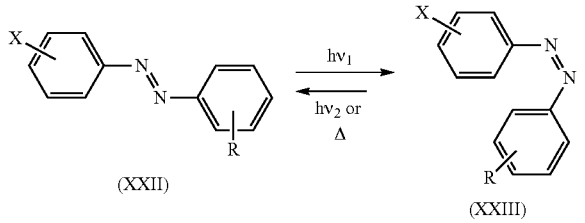

(XXII) (XXIII)

a derivative of a spiropyrane comprising the structural formula (XXIV), which changes in the corresponding meroderivative comprising the structural formula (XXV) where R1, R2, R3 and/or R4 form part of or comprises the anchoring part or the stabilizing part and X comprises or forms part of the stabilizing part or the anchoring part respectively;

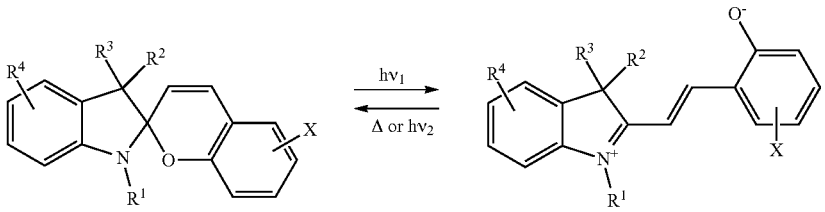

(XXIV) (XXV)

X = C, N a derivative of a spirooxazine comprising the structural formula (XXVI), which decomposes to a corresponding meroderivative comprising the structural formula (XXVII), where R1, R2, R3 and/or R4 form part of or comprises the anchoring part or the stabilizing part and X comprises or forms part of the stabilizing part or the anchoring part respectively; or a combination thereof.

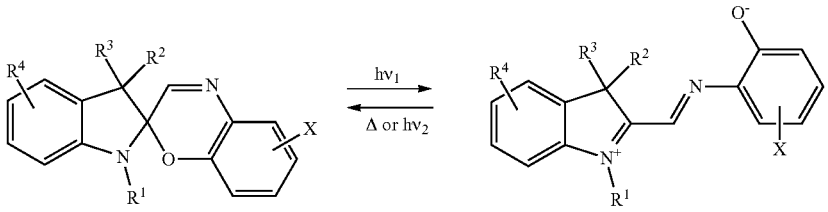

(XXVI) (XXVII)

X = C, N

Preferably, the decomposable part is a derivative of a photodecomposer. A photodecomposer is a compound which decomposes after exposure to UV light, visible light or infrared light and causes a covalent bound to break.

Preferably the photodecomposer is selected from the group consisting of:

ortho-nitrobenzyl moiety;

bis(2-nitrophenyl)methylformate moiety;

(E)-di(propane-2-yl)diazene moiety;

2-fenyl-2-hydroxy-1-phenylethanone moiety;

2-oxo-1,2-diphenylethyl formate moiety;

hydroxyacetophenone derivative;

alkylaminoacetophenone derivative;

benzyl ketal derivative comprising the compound with structural formula (XVI);

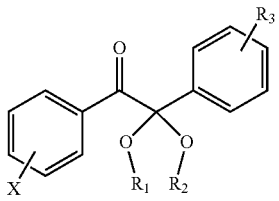

(XVI)

a TPO derivative (i.e. a derivative of (diphenylphosphoryl)(2,4,6-trimethylphenyl)methanone);

a TPO-L derivative (i.e. a derivative of phenyl-(2,4,6-trimethyl-benzoyl)-phosphinic acid ethyl ester);

a BAPO derivative ((i.e. a derivative of [phenyl-(2,4,6-trimethyl-benzoyl)-phosphinoyl]-(2,4,6-trimethyl-phenyl)-methanon); or a combination thereof.

Preferably, the stimulus responsive part is a conformational changeable part which is a photoisomeriser, or a derivative thereof. A "photoisomeriser" is a compound that undergoes a conformational change after exposure to UV-light, visible light of infrared light. An example of a photoisomeriser is a photochrome. Preferably, the photoisomerisor is selected from the group consisting of:

a derivative of trans-stilbene (i.e. 1,1'-(E)-ethene-1,2-diyldibenzene);

a derivative of trans-azobenzene (i.e. (E)-diphenyldiazene);

a derivative of a spiropyrane;

a derivative of a spirooxazin; or a combination thereof.

In the context of the application "derivative" is to be understood as the basis skeleton of the compound as is shown via the compound name or the structural formula. The derivative may comprise a compound with other moieties, comprising but not limited to the anchoring part or the stabilizing part. A "derivative" may also refer to a radical form of the basis skeleton of the compound as is shown via the compound name or the structural formula.

Another aspect of this invention is related to the use of a toner liquid as described above in a digital printing apparatus or process as described above. The advantages, embodiments and preferred forms for the toner liquid and the digital printing apparatus as described above correspond *mutatis mutandis* with this aspect of the invention.

According to yet another aspect of the invention, there is provided a substrate suitable for printing using liquid toner, preferably a liquid toner according to any one of the embodiments above, said liquid toner comprising a carrier liquid, a dispersing agent, and imaging particles, wherein the substrate contains a compound adapted for reducing the dispersing capacity of the dispersing agent (with or without additional stimulus).

The technical effects and advantages of the various embodiments of the process and the toner liquid according to the present invention correspond mutatis mutandis to those described above in connection with the apparatus of according to the invention.

Figure 2:
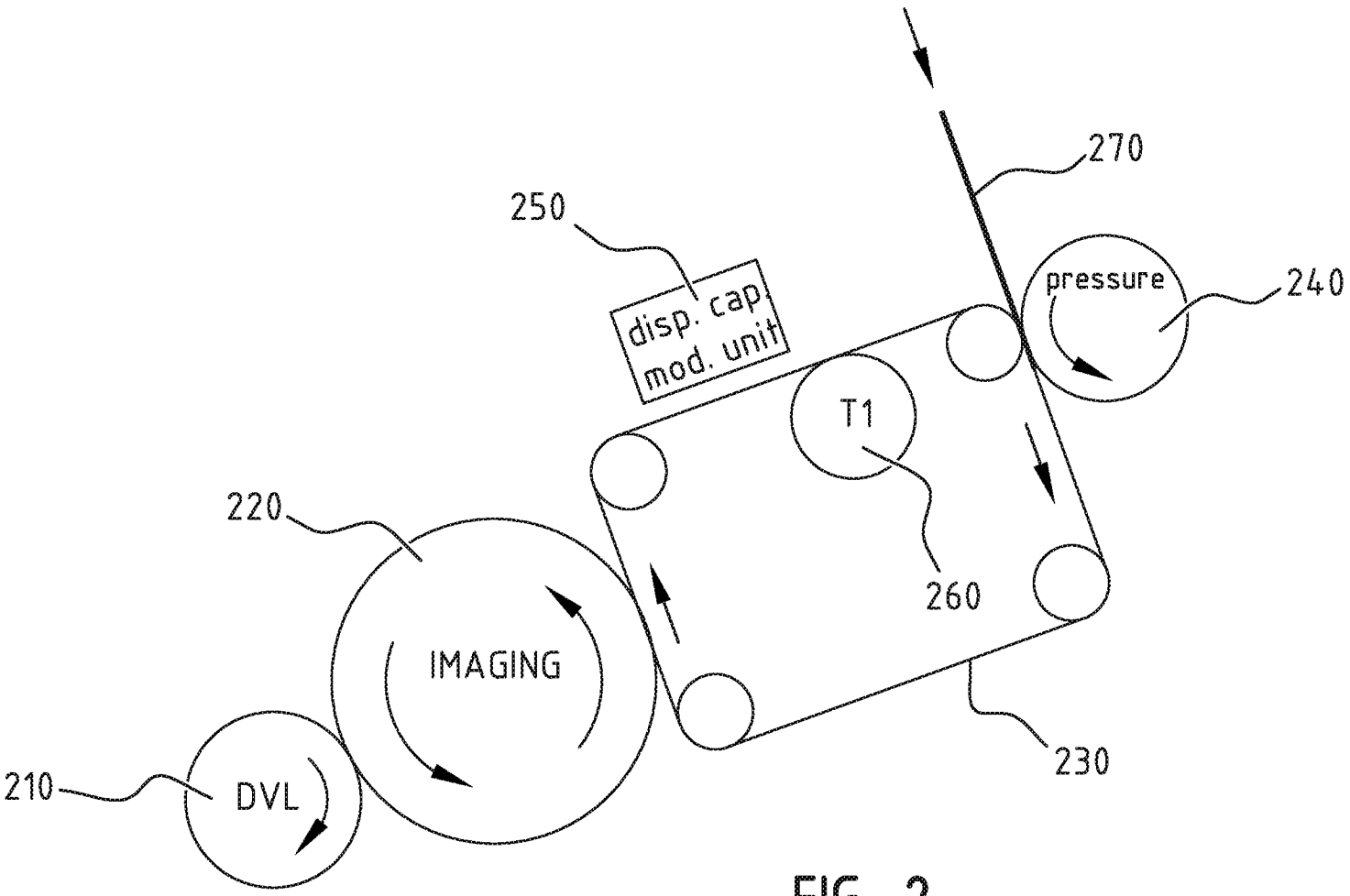
Figure 3:
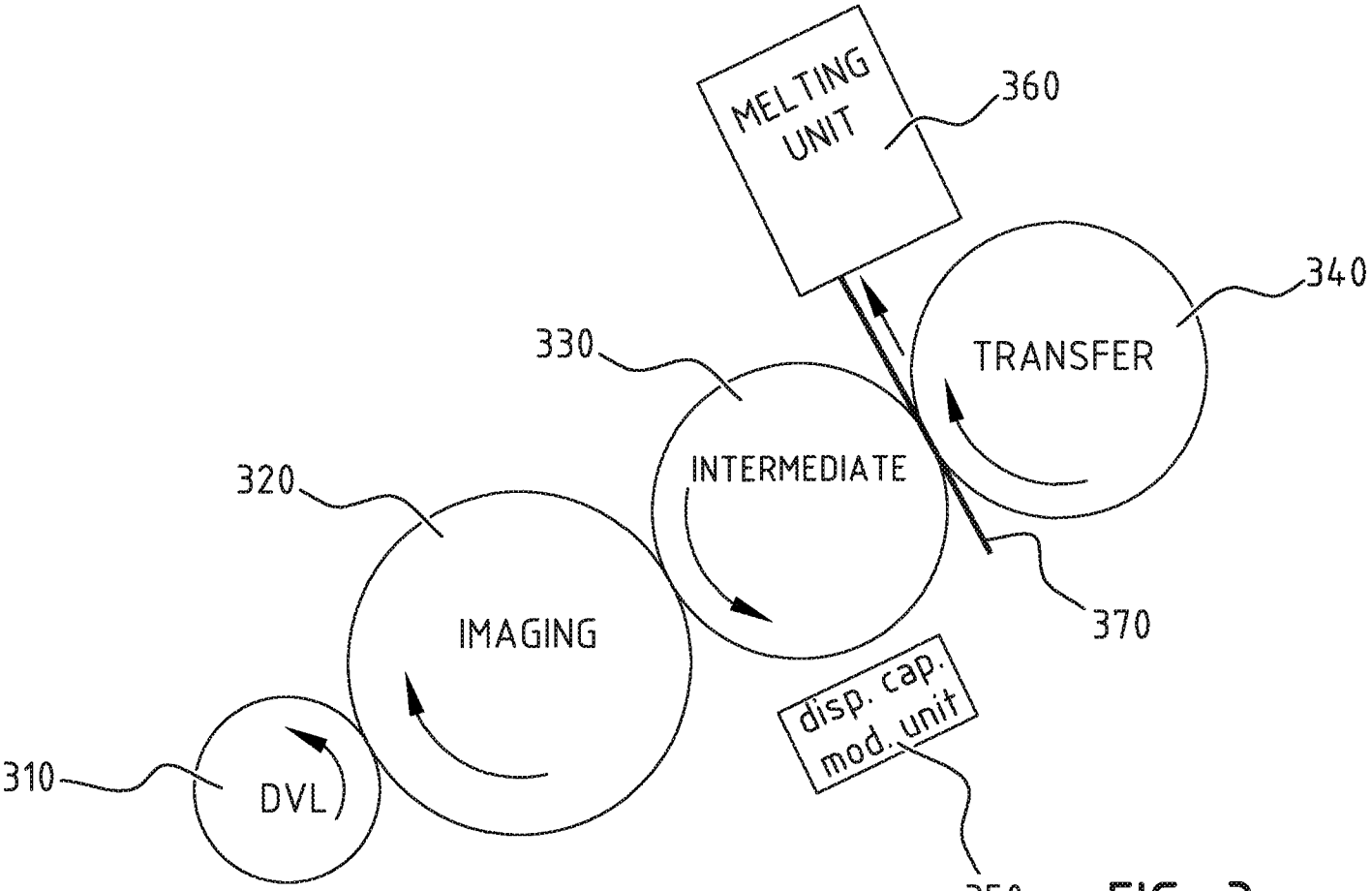
Figure 4:
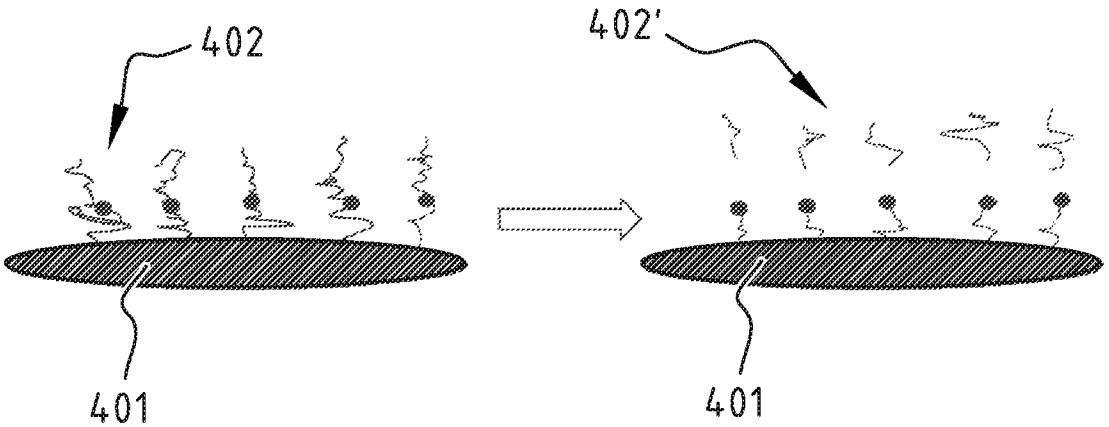
Figure 5:
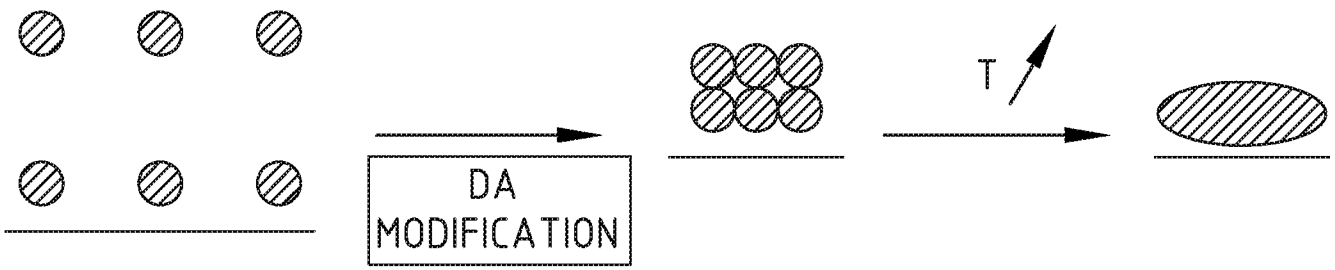

These and other technical effects and advantages of embodiments of the invention will be described in more detail in connection with the accompanying figures, in which:

FIG. 1 presents a schematic diagram of an apparatus according to a first embodiment of the present invention;

FIG. 2 presents a schematic diagram of an apparatus according to a second embodiment of the present invention;

FIG. 3 presents a schematic diagram of an apparatus according to a third embodiment of the present invention;

FIG. 4 illustrates schematically the decomposing of the dispersing agent in a dispersing capacity modification unit according to an embodiment of the invention; and FIG. 5 illustrates schematically the effects of an embodiment of the method of the invention on imaging particles in a portion of liquid toner.

In xerography processes operating with liquid toner, the imaging particles or marking particles are supplied as solid particles suspended in a carrier liquid. The imaging particles consist of pigment grains, typically embedded in a small bead of resin, with an average diameter of for instance 2 μm. A dispersing agent or dispersant is added to the mix to avoid clustering of the toner particles. Dispersants deflocculate the imaging particles and thus significantly reduce the viscosity of the liquid toner dispersion. A dispersing agent is added to produce stable formulations and ensure stability (e.g. viscosity stability) during storage and during developing/imaging.

The carrier liquid may comprise any suitable liquids as is known in the art, and may include silicone fluids, mineral oils, low viscosity or high viscosity liquid paraffin, isoparaffinic hydrocarbons, fatty acid glycerides, fatty acid esters, vegetable oils, chemically modified vegetable oils, or any combinations thereof. The carrier liquid may further contain variable amounts of charge control agent (CCA), wax, plasticizers, and other additives, although they also can be incorporated into the toner particle itself.

The carrier liquid may be volatile or non-volatile. For volatile carrier liquids, embodiments of the invention will allow obtaining an improved phase separation and therefore evaporation of the carrier liquid will be facilitated.

An advantageous liquid developer dispersion for use in a digital printing apparatus of the invention comprises a non-volatile carrier liquid, marking particles and a dispersing agent in the form of a dispersing compound or a combination of dispersing compounds, wherein the marking particles in the liquid developer dispersion are stabilized during storage and during printing before fusing and wherein at fusing temperature liquid toner collapses and a marking particle phase and a carrier liquid phase are formed. Such a liquid developer dispersion is disclosed in European patent application with application number 12186676.8 in the name of the Applicant. Using embodiments of the invention, the starting toner dispersion can be made more stable, the collapsing speed may be increased and the fusing results can be further improved.

An exemplary digital printing system using liquid toner is described in more detail in US patent application with publication no. 2009/0052948, the content of which is incorporated into this application in its entirety by this reference. US 2009/0052948 is specifically concerned with highly concentrated liquid toner development systems (designated as "high viscosity" toner or HVT systems), used at high printing speeds, in particular, printing speeds greater than 0.5 $ms^{-1}$. Without loss of generality, any features described in the present application which are not specific to the present invention may be implemented in accordance with the examples and alternatives specified in the cited US patent application publication, or combined with same.

Similarly, the apparatus and process of the present invention preferably utilizes toner with solids concentrations between 5% and 60 wt %, preferably between 15% and 45 wt %. The high-shear viscosity, as measured at a shear rate of 3000 $s^{-1}$ at 25° C. with a cone plate geometry of C60/1° and a gap of 52 μm, is preferably in the range of 5-500 mPa·s.

FIG. 1 schematically illustrates a first embodiment of a printing apparatus comprising a development member 110, an imaging member 120, an optional intermediate member 130, a transfer member 140, a melting unit 160, and a dispersing capacity modification unit 150. Without loss of generality, the aforementioned members are all illustrated and described as rollers. The development member 110, imaging member 120, and intermediate member 120 all transfer part of the liquid toner adhering to their surface to their successor; the part of the liquid toner that remains present on the member's surface is removed after the transfer stage by appropriate removal means (not illustrated). Excess carrier liquid present on the substrate 170 after printing may be in part removed and/or in part absorbed by the substrate during the substrate's stay in the melting unit 160.

The development member 110 may be supplied with liquid toner from a reservoir via a toner supply roller and a metering roller (not illustrated), with a pick-up roller and/or a feeder roller optionally arranged between them (not illustrated). Preferably, a carrier liquid displacement device (not illustrated) is provided, which may take various forms, including the form of a corona generating device or the like, or it may take the form of a roller type mechanism. The carrier liquid displacement device is placed upstream of the interface with the imaging member 120, in a position adjacent to the development member 110, and is configured to create a spatial separation of the toner particles and the carrier liquid within the toner deposit, whereby the carrier liquid is displaced to the surface of the toner layer, to supply or adjust the charge on the individual toner particles and to provide additional particle compaction for enhanced density uniformity of the developed image.

Electrostatographic printing processes involve the creation of a visible image by the attraction of charged imaging particles or marking particles to charged sites present on a substrate. Such charged sites, forming a latent image, can be transiently supported on the imaging member 120 which may consist of photoconductors or pure dielectrics and may be rendered visible in situ or be transferred to another substrate to be developed in that location. The imaging member 120 is preferably a photoconductor roll or belt, upon which the latent image is produced by selectively illuminating the roll with a sufficiently focused light source, such as a laser or LED array. In particular, the image forming stage may consist of providing a uniform electrostatic charge to the surface by means of a charging device, and selectively discharging the uniform electrostatic charge by illumination, to form the electrostatic latent image.

In the development stage, toner particles travel from a development member 110 supplied with a thin, film-like layer of liquid toner, onto the imaging member 120 that carries the latent image. In a subsequent step, the developed image is transferred from the imaging member 120 onto the intermediate member 130. An intermediate roller 130 with a sufficiently elastic surface, e.g. a surface made of hardened rubber or a suitable elastomer, may be used when the surface of the printing substrate is not perfectly smooth. This is the case when the printing substrate is uncoated paper or a textured substrate. The elasticity of the surface of the intermediate roller will allow the deposition of an image with appropriate quality, thanks to the roller's ability to adapt to the unevenness of the substrate. In the final transfer step, the developed image is transferred from the intermediate roller 130 onto the substrate 170, which is supported by the transfer roller 140 that is kept at a suitable potential.

The melting unit 160 is arranged downstream of a contact surface between the intermediate roller 130 and the transfer roller 140. The melting unit 160 is configured to melt imaging particles of a transferred part of the portion of liquid toner on the imaging member 120. In the melting unit 160, the image on the substrate 170 is fixed. Preferably the melting unit uses heat and compression between rollers. Alternatively, the image melting unit uses non-contact methods such as IR, UV and EB curing or other known methods of image fusing.

There is provided a dispersing capacity modification unit 150 upstream of the melting unit 160 and downstream of the intermediate member 130. The dispersing capacity modification unit 150 is configured for reducing the dispersing capacity of the dispersing agent in the liquid toner dispersion present on the substrate 170. Preferably, the dispersing agent is chemically modified, e.g. at least partially decomposed, or conformationally changed by the dispersing capacity modification unit 150 so that the dispersing agent will not hinder the melting in the melting unit 160. The decomposing or conformational change will typically be the result of a reaction changing the dispersing capacity of the dispersing agent. By reducing the dispersing capacity, it is avoided that the liquid toner dispersion becomes an emulsion without the formation of a film of imaging particles. In embodiments the dispersing capacity modification unit 150 is configured to subject the liquid toner to a stimulus, in order to cause a chemical reaction reducing the dispersing capacity of the dispersing agent. The stimulus may be e.g. UV-light, infrared light, microwave, a change in temperature, a change in pH value, or an interaction with an added compound. If a compound is used, it is noted that this compound could be present beforehand on the printing substrate 170, so that the dispersion capacity modification unit 150 may be omitted.

In the embodiment of FIG. 1 the dispersing agent modification unit 150 and the melting unit 160 are illustrated as two separate units. However, according to alternative embodiments, the dispersing capacity modifying unit 150 and the melting unit 160 may be grouped in a single unit. In such an embodiment the reducing of the dispersing capacity may be performed simultaneously with the melting of the liquid toner.

In the embodiment of FIG. 1 the dispersing agent modification unit 150 is arranged upstream of the melting unit 160, but the dispersing agent modification unit 150 may also be arranged downstream of the melting unit 160, provided that the temperature of the liquid toner is still sufficient to allow adherence to the substrate after having passed the dispersing agent modification unit 150.

A second embodiment of a digital printing process according to the present invention will now be described in connection with FIG. 2. The printing apparatus comprises a development member 210, an imaging member 220, an intermediate member 230, a melting unit 260, a pressure member 240, and a dispersing capacity modification unit 250. The members 210 and 220 may be similar to the corresponding elements of the first embodiment and reference is made to the description of those elements given above. Downstream of the imaging roller 220, there is provided an intermediate member in the form of a belt 230. The melting unit takes the form of a fuse roller 260 arranged along the intermediate belt 230, upstream of the pressure roller 240 and downstream of the imaging roller 220. The fuse roller 260 is configured to fuse imaging particles of a transferred part of liquid toner using heat. The fuse roller 260 is brought at a temperature T1 suitable for melting the liquid toner. The roller 260 can also be at the outside of the member 230 or opposite to member 240 to form a nip and assist the transfer to the paper. Optionally there may be provided a cooling means operative on the intermediate belt 230, downstream of the rotational contact between the pressure roller 240 and the intermediate belt 230.

The dispersing capacity modifying unit 250 is also provided between the imaging roller 220 and pressure roller 240 in order to change the dispersing capacity of the dispersing agent in the liquid toner that is going to be fused. In the illustrated embodiment the dispersing agent modifying unit 250 is located upstream of the melting unit 260, but it is also possible to arrange the dispersing agent modifying unit 250 downstream of the melting unit 260. In that case the liquid toner will be molten first, whereupon the dispersing capacity is reduced to promote the formation of a film.

A third embodiment of a digital printing process according to the present invention will now be described in connection with FIG. 3. The printing apparatus comprises a development member 310, an imaging member 320, an intermediate member 330, a transfer member 340, a dispersing capacity modification unit 350 and a melting unit 360. The members 310, 320, 330, and 340 may be similar to the corresponding elements of the first embodiment and reference is made to the description of those elements given above. In the third embodiment the dispersing capacity modification unit 350 is arranged upstream of an area of contact between the intermediate roller 330 and the transfer roller 340, and reduces the dispersing capacity of the liquid toner before being transferred to the substrate 370. The melting unit 360 is arranged downstream of said area, and operates directly on the substrate 370. The melting unit 360 is configured to melt the transferred image particles, to cause adherence of the image particles to the substrate and to remove a part of the carrier liquid.

It will be understood that all features described in more detail in connection with the apparatus of FIGS. 1, 2 and 3, apply also to the process according to the invention, with the same technical effects and advantages. Hence, these features and their operation will not be repeated.

Additionally, while the invention has been described hereinabove in connection with a single imaging stage (single-color printing), it will be appreciated by a person skilled in the art that the relevant parts of the invention can be replicated several times to allow for multi-color printing. In such a case one could transfer all images onto the substrate and then use only one dispersing stability modification unit and one melting unit. According to an exemplary embodiment, when printing different colors, e.g. in the embodiment of FIG. 2, there could be provided four imaging rollers around the belt 230. According to another variant, the embodiment of FIG. 3 could be implemented with a large intermediate member 330 surrounded by four imaging members.

Throughout the application, the various stages off the printing system have been described as members. In specific cases, these members have been described and/or illustrated as rollers. The skilled person will appreciate that the same principles may be applied with suitably designed belts.

FIG. 4 illustrates schematically the effect of a dispersing capacity modification unit according to an embodiment of the invention on liquid developer dispersion. Before entering the dispersing capacity modification unit, the imaging particles 401 are stabilized in the liquid developer dispersion by the dispersing agent 402. The dispersing capacity modification unit subjects the dispersing agent to a reaction, e.g. a photochemical reaction, deactivating or reducing its dispersing capacity, resulting in a modified dispersing agent 402'. The reduced dispersing capabilities of the modified dispersing agent 402' lead to an improved fusing of the imaging particles. This results in a better adherence to the substrate.

FIG. 5 illustrates schematically a dispersing agent (DA) modification step followed by a melting step. Before performing the DA modification step the imaging particles 501 are well dispersed in the liquid toner. By subjecting the dispersing agent to a suitable reaction the dispersing capacity of the agent is reduced or eliminated so that imaging particles 501' can approach each other. Next, heating at a suitable temperature causes the melting of the particles 501" and film formation. Although FIG. 5 illustrates a DA modification step followed by a heating step, the skilled person understands that those steps may be inverted of may be performed simultaneously.

Embodiments of the invention allow choosing a dispersing agent which is very stable during the production, the storage, the transport, the developing and imaging steps and which can be fused at an acceptable temperature, speed and film quality thanks to the introduction of a DA modification step.

The examples provide synthesis examples of dispersing agents that can be used in liquid toner according to the invention.

EXAMPLE 1

The Decomposable Art is Located Between the Anchoring Art and the Stabilizing Art Polyhydroxystearic acid chains (PHSA) have optimal stabilizing effect in nonpolar media such as mineral oils and vegetable oils.

Reaction Scheme:

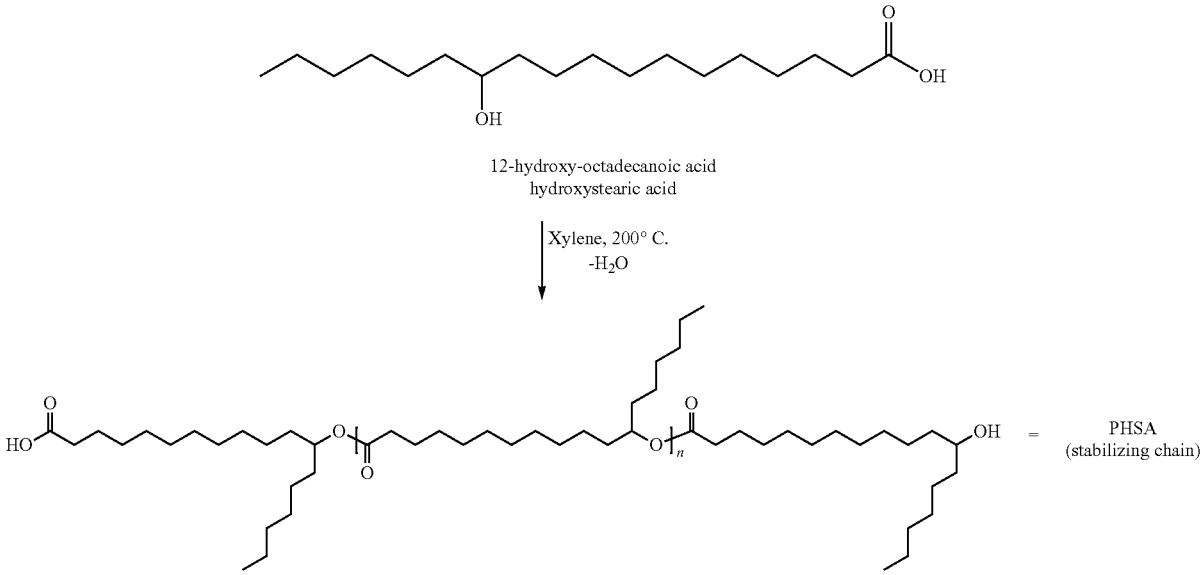

1.1 Synthesis of Polyhydroxystearic Acid

In a 250 ml flask equipped with a Dean-Stark apparatus and a reflux condenser, there are added 100 g of 12-hydroxyoctadecanoic acid (12-hydroxystearic acid) and 50 ml of mixed xylene. The reaction mixture is heated under nitrogen in an oil bath at 195-200° C., and refluxed for 36 h. The progress of the reaction can be monitored by the amount of separated water. The degree of condensation was determined by means of IR and titration. In the IR spectroscopy is the carbonyl stretch ratio of the carboxylic acid and the ester a measure of the degree of condensation. By means of titration, the acid value can be determined. In this example, it amounted to 35 mg KOH/g, which is a value of n=4 yields, or 6 HSA units.

In the following synthetic sequence, the photolabile group is synthesized and also the coupling of the anchoring and the stabilizing part.

Reaction Scheme:
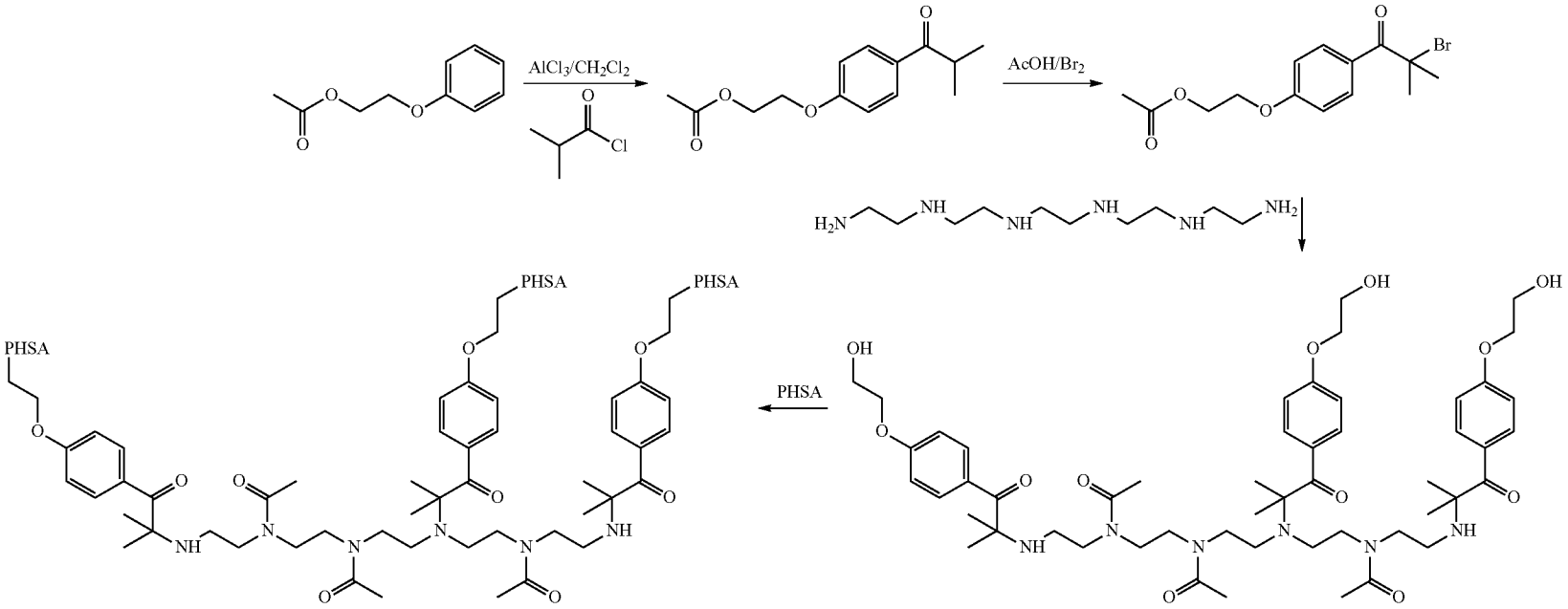

1.2 Synthesis of 2-[4-(2-methylpropanoyl) phenoxy] ethyl acetate

To a stirred solution of 29.4 g anhydrous aluminum trichloride at −5 to −0° C. in 20 ml of dichloromethane, 11.2 g of butaric acid is added dropwise during 30 min. After this, 18.0 g of 2-phenoxyethyl acetate is added dropwise at the same temperature for 1 h. The reaction mixture is stirred for 2 h at this temperature and then poured into a mixture of 60 ml concentrated HCl-solution and 80 ml of water. The organic phase is separated and the aqueous phase is extracted with 60 ml of dichloromethane. The organic phases are combined and washed with water, dried and evaporated in vacuo. 24.7 g (98.7%) of 2-[4-(2-methylpropanoyl) phenoxy] ethyl acetate was obtained.

1.3 Synthesis of 2-[4-(2-bromo-2-methylpropanoyl) phenoxy]ethyl acetate 25 g of 2-[4-(2-methylpropanoyl)phenoxy]ethyl acetate from example 1.2 is dissolved in 20 ml of glacial acetic acid. To this, 19.2 g of bromine is added dropwise with stirring at room temperature over 2 h. After 10 h stirring, the reaction mixture was poured into 300 ml of glacial acetic acid and extracted with 3×150 ml of ethyl acetate. The combined extracts are dried with magnesium sulfate, filtered and evaporated to a viscous oil.

In the next step, the photo-labile component is coupled with a polyethylenimine (PEI). This can be a linear or a branched PEI (such as the Lupasol® polyethylenimines from BASF or the EPOMIN® products of Nippon Shokubai). In the synthesis described below, is worked with the linear pentaethylenehexamine (PEI-6).

1.4 Synthesis of 2-[4-(2-bromo-2-methylpropanoyl)phenoxy] ethyl acetate adduct to PEI-6

25 g of 2-[4-(2-bromo-2-methylpropanoyl)phenoxy]ethyl acetate from 1.3 is dissolved in 100 ml of ethanol With stirring, 7.7 g of pentaethylenehexamine and then 15 g of N, N-diisopropylethylamine were added. After 2 h stirring, if necessary, the remaining free amino groups are acetylated with acetic anhydride and then 38 g of a 32% sodium hydroxide solution was added at room temperature Ethanol is evaporated off and 300 ml of water is added. This mixture is extracted with 3×50 ml each of ethyl acetate. The organic phase is dried with sodium sulphate, filtered and evaporated.

1.5 Coupling of the Product of 1.4 and the PHSA from Example 1.1

12.5 g of CDI (carbonyldiimidazole) is mixed in 25 ml of ethyl acetate with 125 g PHSA from Example 1.1. After 30 min of stirring, 25 g of the product from example 1.4, dissolved in 25 ml of ethyl acetate, are added. This mixture is stirred for 6 to 60° C. After evaporation in vacuo an oil is obtained, and mixed with 50 ml of water and then extracted with 3×50 ml of butyl acetate. After evaporation of the organic phase an oil is obtained which as such can be used as a dispersing agent "example 1".

EXAMPLE 2

Central Decomposable Photolabile Group Comprising the Anchoring Part and the Stabilizing Part Reaction Scheme:

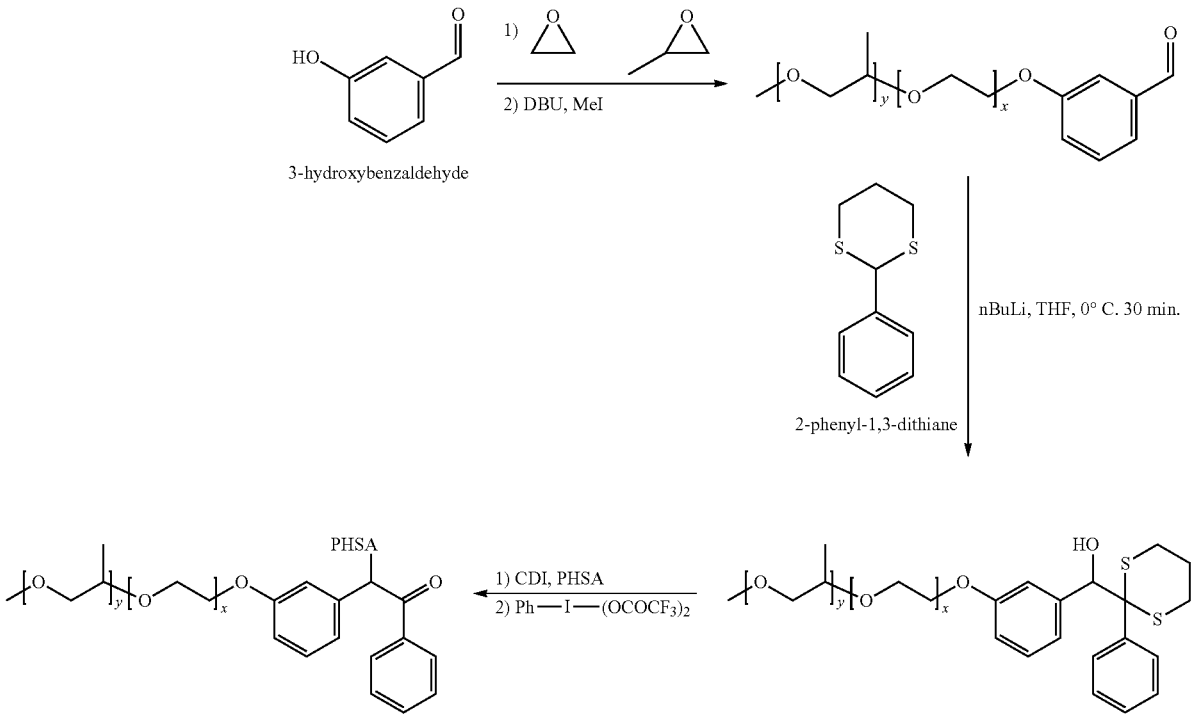

2.1 MeO-PPG-PEG-O-benzaldehyde

To a solution of 12.2 g of 3-hydroxybenzaldehyde and 0.2 g of methanesulfonic acid in 25 ml of tetrahydrofuran (THF) at −20° C., a cooled mixture (−20° C.) of 22.1 g of ethylene oxide and 29.1 g of propylene oxide in 167 ml of THF was added for 90 min. The reaction mixture is stirred for 1 h and brought to room temperature. Then, 16.7 g of DBU was added, and to this 15 g of methyl iodide was added dropwise. After stirring for 1 hour, 100 ml of water was added at room temperature, and the mixture is extracted with 3×100 ml dichloromethane. The combined organic phase is dried, filtered and evaporated under vacuum.

2.2 2-phenyl-1,3-dithiane adduct to PPG-MeO-PEG-O-benzaldehyde of 2.1

A solution of 10.5 g of 2-phenyl-1, 3-dithiane in 50 ml of THF is cooled to 0° C. and to this 3.3 g of butyl lithium was added. After 30 min of stirring, 32.3 g of MeO-PEG-PPG-O-benzaldehyde from example 2.1 was dissolved in 50 mL of THF and added. After 1 h stirring at room temperature, the reaction mixture was quenched by adding 200 ml of ammonium chloride solution. THF was largely removed by vacuum distillation and the remaining phase was extracted with 3×100 ml of dichloromethane. The combined organic phase is dried, filtered and evaporated under vacuum 2.3 Coupling of the Adduct from 2.2 to Polyhydroxystearic Acid and Deprotection of the Dithiane Protective Carbonyl Group The procedure for coupling with the polyhydroxystearic acid is analogous as in example 1.5. The obtained oil is dissolved in 100 ml of acetonitrile and to this 2 equivalents of [Ns (trifluoroacetoxy) iodo] benzene were added. After 20 min of stirring, 50 ml of water was added at room temperature, and after an additional 1 h of stirring, the acetonitrile is evaporated. Then 100 ml of water was added and the remaining phase is extracted with 3×100 ml of dichloromethane. The combined organic phases are dried, filtered and evaporated under vacuum. The thus obtained dispersing agent can be used as such as dispersing agent "example 2".

EXAMPLE 3

The Anchoring Part is Connected with the Stabilizing Part Comprising Decomposable Groups Reaction Scheme:
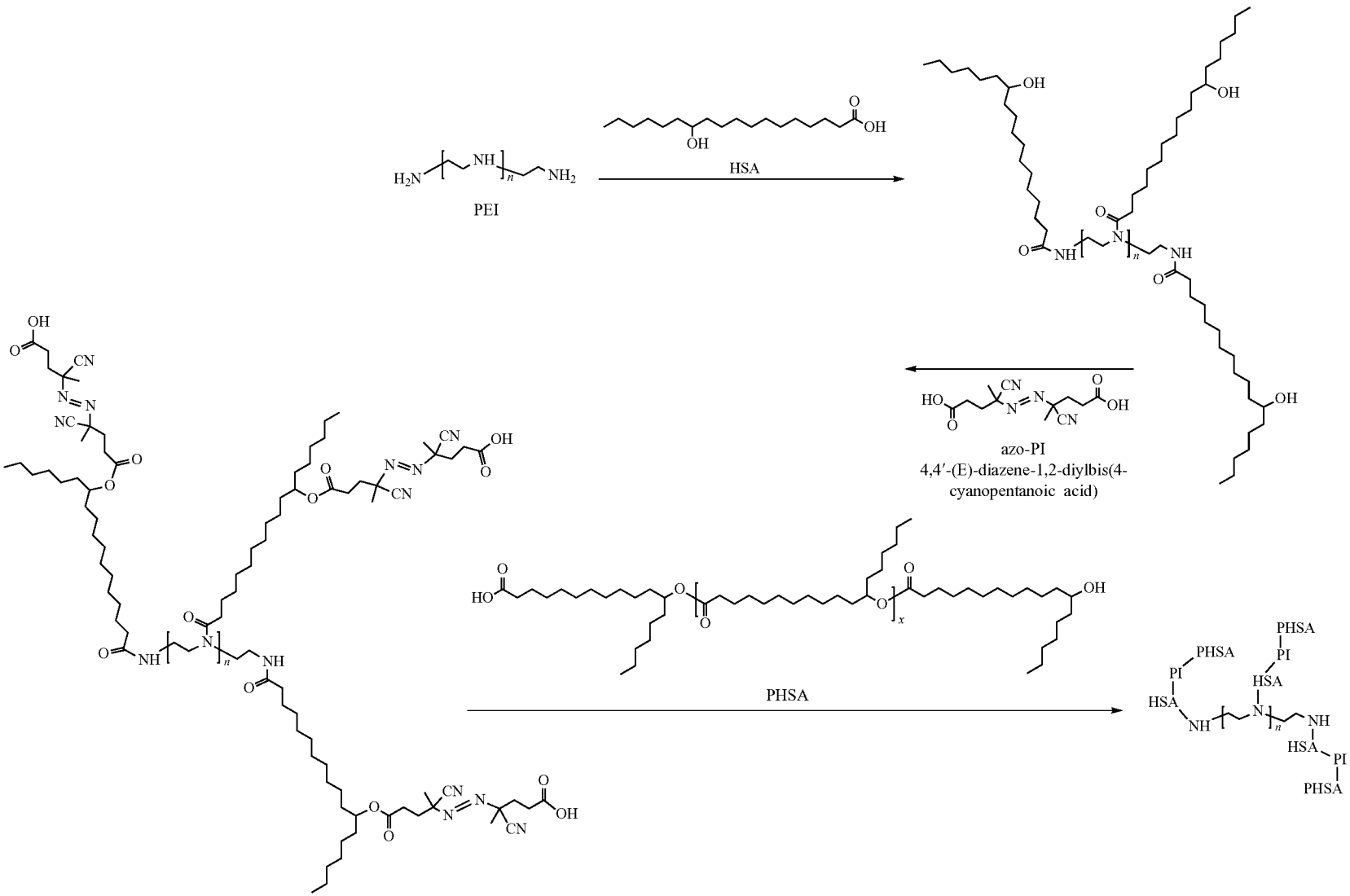

3.1 Coupling of Polyethylenimine with 12-hydroxysteraric Acid 23.2 g of pentaethylenehexamine is mixed together with 90.1 g of 12-hydroxystearic acid under a nitrogen flow for 6 h and heated at 150° C. After cooling, a waxy solid is obtained.

3.2 Coupling HSA-PEI Polymer with a Photoinitiator and a Polyhydroxystearic Acid 9.4 g PEI-HSA from 3.1 is coupled by means of CDI with 8.4 g of photoinitiator 4,4'-(E)-diazene-1,2-diylbis (4-cyanopentanoic acid), and then with 48.9 g polyhydroxystearic acid (Mw 1630, example 1.1) using the procedure described in example 1.5, with the difference that toluene was used in place of ethyl acetate yielding dispersing agent "example 3".

EXAMPLE 4

The Anchoring Part is Connected with the Stabilizing Part that Comprises the Decomposable Group Reaction Scheme:

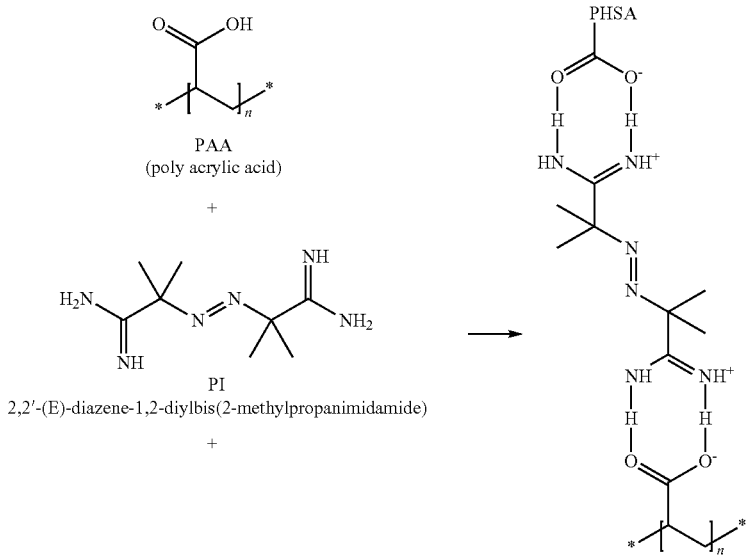

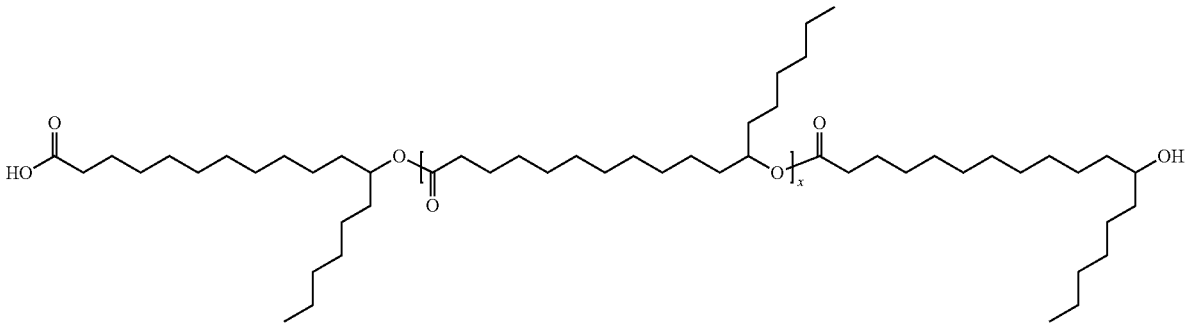

PHSA 4.1 Coupling of Polyacrylic Acid with a Photoinitiator and Polyhydroxystearic Acid The molecular weight (Mw) of the polyacrylic acid and the poly-hydroxystearic acid is first determined by means of titration, so that the stoichiometry of the reaction is ensured. 1.8 g of polyacrylic acid (Mw 1800), 5.0 g photoinitiator. 2,2'-(E)-diazene-1, 2-diylbis (2-methylpropanimidamide) and 40.8 g polyhydroxystearic acid (Mw 1630 Example 1.1) are dissolved in 100 ml toluene at room temperature and stirred for 1 h. Subsequently, the toluene is evaporated under vacuum resulting in a dispersing agent "example 4"

EXAMPLE 5

Stimulus Collapsible Group

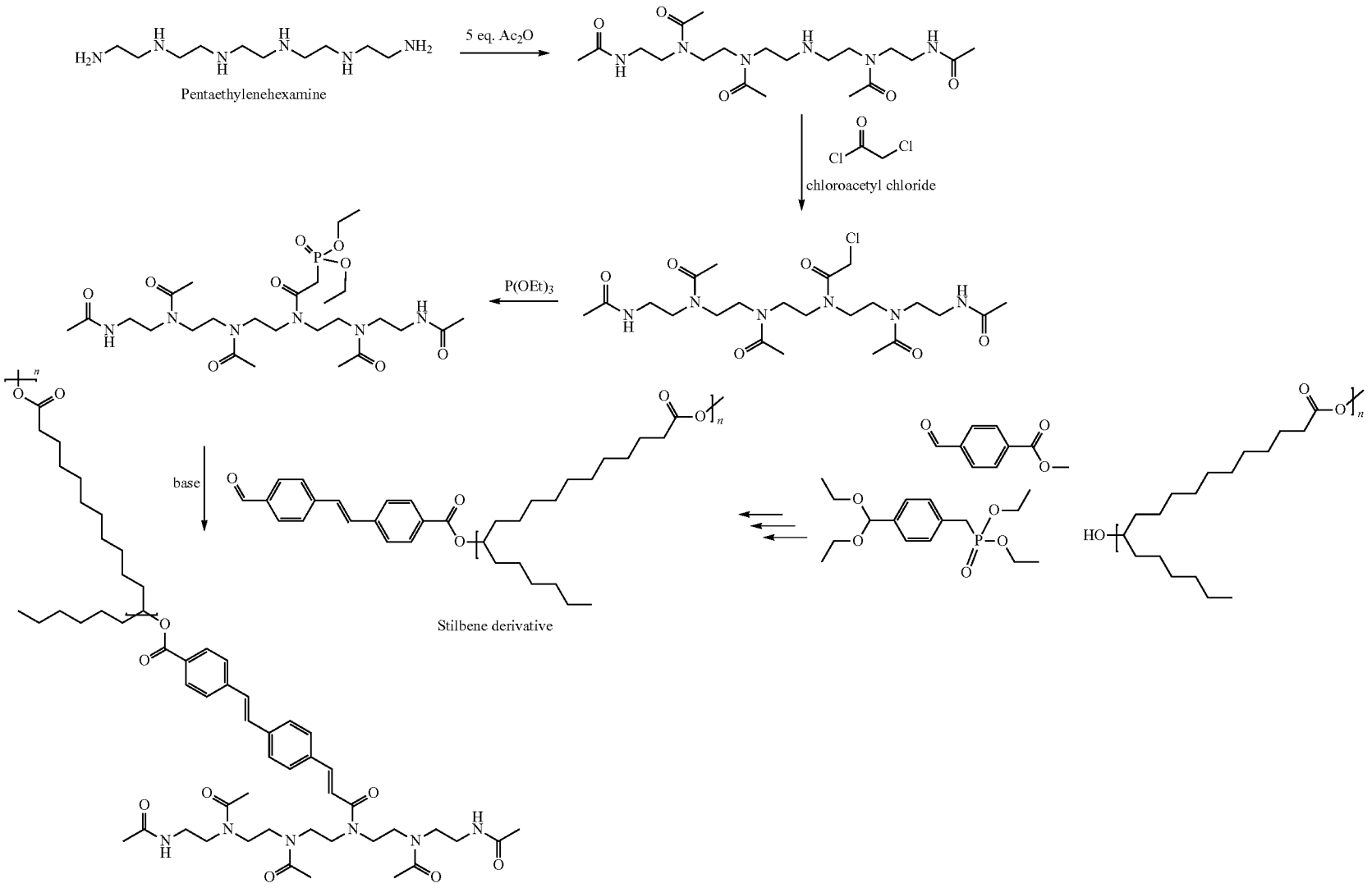
Pentaethylenehexamine
5 eq. $Ac_2O$
chloroacetyl chloride
$P(OEt)_3$
base
Stilbene derivative Pentaethylenehexamine is converted with acetic anhydride to a partially acetylated poly-amine.

This product is further functionalized with chloroacetyl chloride.

The stilbene-aldehyde-derivative is synthesized with a polyester of hydroxystearic acid and conventional synthetic protocols like the Michaelis-Arbuzov and the Wittig-Horner-type reactions. The coupling between the partially acetylated poly-amine derivative and the stilbene-aldehyde-derivative is again accomplished via a Michaelis-Arbuzov and a Horner-Wadsworth-Emmons reaction yielding a conformationally changeable dispersing agent "example 5".

Liquid Toner Examples and Testing of the Toners while Printing

A liquid toner was prepared by first extruding a polyester (AV=10 mg KOH/g and Tg=61° C.) with 5% of a suphonamide plasticizer and 12.5% of PB 15:3 cyan pigment in an extruder. Afterwards the extrudate was cooled down and dry milled to a particle size of 5 to 20 μm.(=marking particles) During the next step the dry milled toner is further milled down in a bead mill to 1.5 to 2.5 μm in a carrier liquid with viscosity of 5 mPas. Table 1 shows examples of liquid toners prepared as described and indicates the amount of marking particles, carrier liquid and dispersing agent (DA) in the liquid toner in weight percentages (%) pertaining to the weight of the liquid toner.

TABLE 1

| Toner example | % marking particles | % Carrier liquid | DA |
|---|---|---|---|
| 1 | 35 | 61.5 | 3.5% Solsperse 11000 |
| 2 | 35 | 61.5 | 3.5% Solperse 13940 |
| 3 | 35 | 61 | 4% of dispersing agent "example 1" |
| 4 | 35 | 61.25 | 3.75% of dispersing agent "example 2" |
| 5 | 35 | 60.9 | 4.1% of dispersing agent "example 3" |
| 6 | 35 | 60.5 | 4.5% of dispersing agent "example 4" |
| 7 | 35 | 61.0 | 4% of dispersing agent "example 5" |

Solsperse 11000 and 13940 are commercially available products from Lubrizol Ltd

The liquid toners from table 1 were tested in a print engine as described in FIG. 1. A toner layer thickness on the imaging member of 3 to 7 μm was applied to achieve an optical density of 1.4 to 1.7. Table 2 shows the results where the following evaluation criteria is used:

Dispersion Stability

5: very good

3: acceptable

1: very bad

Adhesion:

Adhesion is a measure for the fusing and is evaluated by tape test. A tape is put on the image with a certain amount of pressure (e.g. by using a roller with a certain weight) and afterwards removed. The ratio of the optical density after and before the tape test is a measure for the adhesion.

5: very good—tape test >95%

4: good: tape test >75%

3: acceptable: tape test >50%

2: bad: tape test <30%

1: very bad: tape test <10%

TABLE 2

| Print sample | Toner example (table 1) | DA stimuli | Inv/comp | Dispersion stability | adhesion |
|---|---|---|---|---|---|
| 1 | 1 | — | Comp | 5 | 1 |
| 2 | 1 | UV | Comp | 5 | 1 |
| 3 | 2 | — | Comp | 2 | 4 |
| 4 | 2 | UV | Comp | 2 | 4 |
| 5 | 3 | — | Comp | 4 | 1 |
| 6 | 3 | UV | Inv | 5 | 5 |
| 7 | 4 | UV | Inv | 4 | 5 |
| 8 | 4 | — | Inv | 4 | 1 |
| 9 | 5 | UV | Inv | 3 | 4 |
| 10 | 6 | UV | Inv | 5 | 4 |
| 11 | 7 | UV | Inv | 3-4 | 4 |

As UV stimuli a mercury bulb (254 nm) was used for print samples 1-10. For print sample 11, a mercury bulb of 365 nm was used. As melting unit an IR lamp was used creating a substrate surface temperature of 80° C.

From table 2 it is clear that with the commercially available dispersing agent (print samples 1 to 4) it was not possible to obtain a liquid toner that provides a good adhesion and a good dispersion stability. Also the use of a stimulus responsive dispersing agent does not improve the adhesion for these toners.

For the dispersing agents according to the invention (see print sample 6, 7, 9, 10, 11), the dispersion stability is good, and, when a stimulus is applied before the melting unit, also the adhesion is very good.

In case one of the new designed dispersing agents is used while the stimulus is not applied (e.g. ex 8), the adhesion of the toner system to the substrate is not so good because the stability of the dispersion is too high.

While the invention has been described hereinabove with reference to specific embodiments and examples, this is done to illustrate and not to limit the invention. The skilled person will appreciate that other ways of implementing the inventive concept described herein are within the scope of the invention, as defined by the accompanying claims.

The invention claimed is:

1. A digital printing process using liquid toner, said liquid toner comprising imaging particles, a carrier liquid, and a dispersing agent, said process comprising:

producing a latent image as a pattern of electric charge on an imaging member;

transferring a quantity of liquid toner onto a development member;

developing said latent image by transferring a portion of said quantity of liquid toner onto said imaging member in accordance with said pattern;

melting imaging particles of a portion of liquid toner transferred from the imaging member to a substrate; and adhering said melted imaging particles to the substrate; wherein the dispersing capacity of the dispersing agent in the portion of liquid toner transferred from the imaging member, is reduced, wherein the dispersing capacity of the dispersing agent in the portion of liquid toner is reduced by chemically modifying the dispersing agent.

2. The digital printing process of claim 1, wherein the dispersing agent of the portion of liquid toner transferred from the imaging member is decomposed or conformationally changed.

3. The digital printing process of claim 1, wherein the portion of liquid toner transferred from the imaging member is subjected to a stimulus in order to reduce the dispersing capacity of the dispersing agent.

4. The digital printing process of claim 3, wherein the stimulus is visible light, UV-light, infrared light, microwave, a change in temperature, a change in pH value, a contact with a compound, or a combination thereof.

5. The digital printing process of claim 1, wherein the reducing of the dispersing capacity is performed before the melting; or wherein the reducing of the dispersing capacity and the melting are performed simultaneously.

6. The digital printing process of claim 1, wherein the dispersing agent is a stimulus responsive dispersing agent comprising an anchoring part, a stabilizing part and a stimulus responsive part; wherein the stimulus responsive part is a conformational changeable stimulus responsive part capable of undergoing a conformational change upon exposure to a stimulus, or wherein the stimulus responsive part is decomposed such that the stimulus responsive dispersing agent decomposes in two or more parts.

7. The digital printing process of claim 6, wherein the decomposing in two or more parts occurs through breaking of a covalent bound, or a salt bridge.

8. The digital printing process of claim 6, wherein the conformational change is irreversible during a period that is sufficiently long for performing a digital printing process, or wherein the decomposing is irreversible.

9. The digital printing process of claim 6, wherein the anchoring part and/or the stabilizing part comprises the stimulus responsive part.

10. The digital printing process of claim 6, wherein the stimulus responsive dispersing agent comprises 1, 2, 3, 4, 5, 6, 7, 8, 9, 10, or more stimulus responsive parts.

11. The digital printing process of claim 6, wherein the anchoring part interacts with the marking particle and/or is a derivative selected from the group consisting of: aromate, polyaromate, heteroaromate polyamides, such as carboxylated polyethylenimine, polyester, polyurethane, polyketone, poly(acrylo)nitrile, polyacrylate, vinylether polymer, arylvinyl polymer, and a copolymer of vinylether and arylvinylether, or any combination thereof; and is preferably a carboxylated polyethylenimine; and/or wherein the stabilizing part is a derivative selected from the group consisting of: polysiloxane, polyhydroxystearic acid, polyricinoleic acid, polyacrylate, polyacrylate with long aliphatic chains such as poly-stearic acrylate, polystyrene, polyarylether and polyethylene, or any combination thereof; and is preferably polyhydroxystearic acid.

12. The digital printing process of claim 6, wherein the stimulus responsive dispersing agent is selected from the group consisting of:

an ortho-nitrobenzyl derivative comprising the anchoring part and the stabilizing part;

a derivative of bis(2-nitrophenyl)methylformate, comprising the anchoring part and the stabilizing part;

a derivative of (E)-di(propan-2-yl)diazene comprising the anchoring part and the stabilizing part;

a benzoine derivative with the structural formula (I), wherein R1, R2, R3, and/or R4 form part of the anchoring part, and X comprises the stabilizing part;

(I)

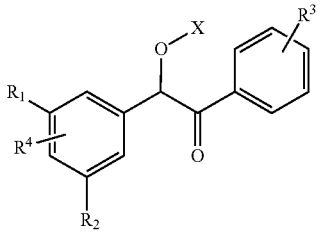

a benzoine derivative comprising the structural formula (IV), wherein R1, R2, R3, and/or R4 form part of, or comprise the anchoring part, and X comprises the stabilizing part;

(IV)

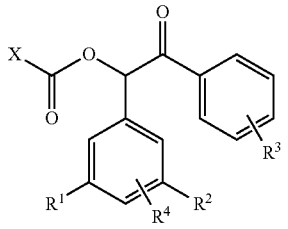

a derivative of hydroxyacetophenone (HAP) comprising the anchoring part and the stabilizing part;

a derivative of alkoxy acetophenone comprising the structural formula (VII), wherein X forms part of, or comprises the stabilizing part, and R1, R2, and/or R3 form part of the anchoring part;

(VII)

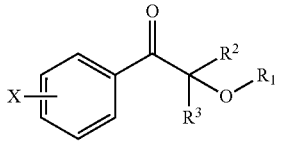

an alkylaminoacetophenone derivative (AAAP) comprising the anchoring part and the stabilizing part;

a derivative comprising the structural formula (XI), wherein X forms part of, or comprises the anchoring part, and R1, R2, R3, and/or R4 form part of, or comprise the stabilizing part;

(XI)

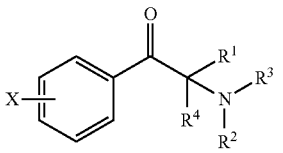

a benzyl ketal derivative comprising the structural formula (XVI) comprising an anchoring and a stabilizing part, wherein R1, R2, and/or R3 form part of, or comprise the stabilizing part, and X comprises or form part of the anchoring part;

(XVI)

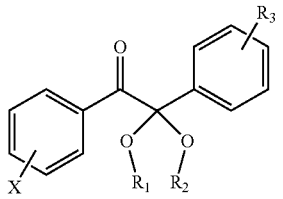

a TPO derivative (i.e. a derivative of (diphenylphosphoryl)(2,4,6-trimethylphenyl)methanone) comprising the anchoring part and the stabilizing part and/or wherein the TPO group forms part or comprises the anchoring part;

a TPO-L derivative (i.e. a derivative of phenyl-(2,4,6-trimethyl-benzoyl)-phosphinic acid ethyl ester) comprising the anchoring part and the stabilizing part and/or of which the TPO-L group forms part of the anchoring part; and a BAPO derivative ((i.e. a derivative of [phenyl-(2,4,6-trimethyl-benzoyl)-phosphinoyl]-(2,4,6-trimethyl-phenyl)-methanon) comprising the anchoring part and the stabilizing part, and/or wherein the BAPO group forms part of the anchoring part; or a combination thereof.

13. The digital printing process of claim 6, where the stimulus responsive dispersing agent is selected from the group consisting of:

a derivative of trans-stilbene (i.e. a derivative of 1,1'-(E)-ethene-1,2-diyldibenzene) comprising the structural formula (XIX), wherein R forms part of, or comprises the anchoring part and X forms part of or comprises the stabilizing part;

(XIX)

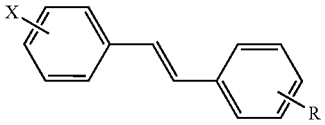

a derivative of trans-azobenzene (i.e. (E)-diphenyldiazene) comprising the structural formula (XXII), wherein R forms part of or comprises the anchoring part, and X forms part or comprises the stabilizing part;

(XXII)

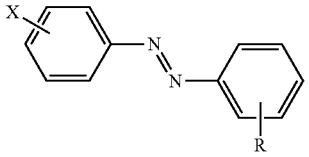

a derivative of a spiropyrane comprising the structural formula (XXIV), wherein R1, R2, R3, and/or R4 form part of or comprises the anchoring part or the stabilizing part and X comprises or forms part of the stabilizing part or the anchoring part; and (XXIV)

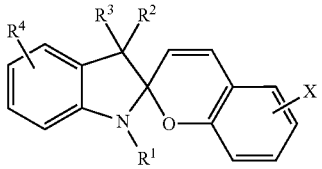

a derivative of a spirooxazine comprising the structural formula (XXVI), wherein R1, R2, R3, and/or R4 form part of or comprises the anchoring part or the stabilizing part and X comprises or forms part of the stabilizing part or the anchoring part respectively; or a combination thereof, (XXVI)

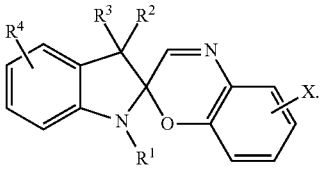

14. The digital printing process of claim 6, wherein the decomposable part is derivative of a photoinitiator and/or is selected from the group consisting of:

ortho-nitrobenzyl moiety;

bis(2-nitrophenyl)methylformate moiety;

(E)-di(propane-2-yl)diazene moiety;

2-phenyl-2-hydroxy-1-phenylethanone moiety;

2-oxo-1,2-diphenylethyl formate moiety;

hydroxyacetophenone derivative;

alkylaminoacetophenone derivative;

benzyl ketal derivative comprising the compound with structural formula (XVI);

(XVI)

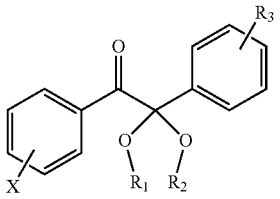

a TPO derivative (i.e. a derivative of (diphenylphosphoryl)(2,4,6-trimethylphenyl)methanone);

a TPO-L derivative (i.e. a derivative of phenyl-(2,4,6-trimethyl-benzoyl)-phosphinic acid ethyl ester); and a BAPO derivative ((i.e. a derivative of [phenyl-(2,4,6-trimethyl-benzoye-phosphinoyl]-(2,4,6-trimethyl-phenye-methanon); or a combination thereof.

* * * * *